US006247537B1

(12) United States Patent
Dallas

(10) Patent No.: US 6,247,537 B1
(45) Date of Patent: Jun. 19, 2001

(54) HIGH PRESSURE FLUID SEAL FOR SEALING AGAINST A BIT GUIDE IN A WELLHEAD AND METHOD OF USING

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 0 days.

(21) Appl. No.: 09/299,551

(22) Filed: Apr. 26, 1999

(51) Int. Cl.[7] ..... E21B 33/03

(52) U.S. Cl. ..... 166/379; 166/115; 166/75.11; 166/242.6; 166/387

(58) Field of Search ..... 166/115, 90.1, 166/85.4, 379, 387, 242.6, 242.7, 75.11, 242.1; 277/611, 612

(56) References Cited

U.S. PATENT DOCUMENTS 1,411,486 * 4/1922 Gallagher ..... 166/115
1,625,378 * 4/1927 Snodgrass ..... 166/88.1
2,187,840 * 1/1940 Penick ..... 166/85.4
2,867,463 * 1/1959 Snider ..... 277/612
4,602,796 * 7/1986 Setterberg ..... 277/236
4,907,651 * 3/1990 Bou-Mikael ..... 166/114
5,012,865 * 5/1991 McLeod ..... 166/90
5,819,851 10/1998 Dallas ..... 166/308

* cited by examiner

*Primary Examiner*—Hoang Dang
(74) *Attorney, Agent, or Firm*—Nelson Mullins Riley & Scarborough, LLP

(57) ABSTRACT

High pressure fluid seals for sealing against a bit guide in wellhead and a method of using the seals are described. The high pressure fluid seals are primarily intended for use with a blowout preventer protector. The high pressure fluid seals are elastomeric material bonded to an end of a mandrel for insertion into the wellhead. The end of the mandrel includes an annular ridge that protrudes into the elastomeric seal to inhibit the seal from being extruded away from the bore when the elastomeric seal is seated against the bit guide and the bore is subjected to elevated fluid pressures. The advantage is a high pressure fluid seal that ensures packoff against a bit guide even if the bit guide is worn but still serviceable. A further advantage is a more secure seal that improves safety and enables the use of higher pressures during well stimulation.

10 Claims, 2 Drawing Sheets

HIGH PRESSURE FLUID SEAL FOR SEALING AGAINST A BIT GUIDE IN A WELLHEAD AND METHOD OF USING

FIELD OF THE INVENTION

This application relates to seals for use in high pressure applications in corrosive environments such as well bores and, in particular, to a high pressure fluid seal for sealing against a bit guide in a well bore.

BACKGROUND OF THE INVENTION

The servicing of oil and gas wells to stimulate production requires the pumping of fluids under high pressure. It has now been demonstrated that it is advantageous to have full access, or substantially full access, to a well casing during a well stimulation treatment. Full access to the casing permits use of downhole tools which are often required, or at least very advantageously used, during a stimulation treatment. An apparatus for providing full access to the casing while permitting stimulation treatments at extreme pressures that approach a burst pressure rating of the casing is described in applicant's U.S. Pat. No. 5,819,851 which issued on Oct. 13, 1998 and is entitled BLOWOUT PREVENTER PROTECTOR FOR USE DURING HIGH PRESSURE OIL/GAS WELL STIMULATION. The patent describes an apparatus for protecting blowout preventers during well fracturing and/or stimulation treatments. The apparatus includes a hollow spool that has spaced-apart inner and outer sidewalls that define an annular cavity. The mandrel is forcibly reciprocatable in the cavity. The mandrel includes an annular seal at a bottom end for sealingly engaging a bit guide attached to the top end of the casing. The apparatus is mounted above a blowout preventer (BOP) attached to a casing spool of the well before well stimulation procedures are begun. The mandrel is stroke down through the BOP to protect it from exposure to fluid pressure as well as abrasive and/or corrosive well stimulation fluids, especially extreme pressures and abrasive proppants. The BOP protector provides a simple, easy to operate apparatus for protecting BOPs which provides full access to the well casing with well servicing tools to facilitate well stimulation at pressures approaching the burst pressure rating of the well casing.

The BOP protector has been readily accepted by the industry and has proven to be an effective tool which reduces the cost of well stimulation treatments while enabling an ultimate choice in treatment options. Field experience has shown that the bit guides of used wellheads tend to become deformed by small chips, dents or scratches after a period of running in and out with production tubing and/or downhole tools. Consequently, the annular seal described in U.S. Pat. No. 5,819,851 sometimes permits pressure leakage under high stimulation pressures.

There therefore exists a need for an improved seal structure for sealing against a bit guide in a well bore which ensures a leak-proof seal at elevated stimulation pressures.

It is therefore an object of the invention to provide an improved high pressure fluid seal for sealing against a bit guide in a wellhead.

It is a further object of the invention to provide a high pressure fluid seal for sealing against a bit guide in a wellhead which maintains an impervious seal when exposed to very high stimulation pressures.

SUMMARY OF THE INVENTION

The invention therefore provides a high pressure fluid seal for sealing against a bit guide in a wellhead, comprising in combination:

a mandrel adapted to be inserted into the wellhead, the mandrel having an inner wall defining a bore, an outer wall and an end for supporting an elastomeric seal, the end including an annular ridge which protrudes into the elastomeric seal to inhibit the seal from being extruded away from the bore when the elastomeric seal is seated against the bit guide and the bore is subjected to elevated fluid pressures.

In accordance with a further aspect of the invention, there is provided a method of performing a well stimulation process, comprising the steps of:

mounting a packoff assembly to an end of a mandrel used to isolate components of a wellhead mounted to the well from elevated fluid pressures used during the well stimulation process, the packoff assembly being adapted to be inserted into the wellhead with the mandrel, the packoff assembly having an inner wall defining a bore, an outer wall and an end for supporting an elastomeric seal, the end including an annular ridge which protrudes into the elastomeric seal to inhibit the seal from being extruded away from the bore when the elastomeric seal is seated against the bit guide and the bore is subjected to elevated fluid pressures;

inserting the mandrel into the wellhead and seating the elastomeric seal against the bit guide in order to isolate components of the wellhead form fluid pressures required for the well stimulation process; and performing the well stimulation process.

The high pressure fluid seals for sealing against a bit guide in a wellhead in accordance with the invention are formed on a lower end of a mandrel which is inserted into a wellhead. The lower end of the mandrel includes at least one annular ridge that protrudes into the elastomeric seal to ensure that the elastomeric seal is not extruded away from the bore when the elastomeric seal is seated against the bit guide. The annular ridge provides an area of concentrated compressive force to compress the elastomeric seal against the bit guide so that an effective seal is achieved even when the bit guide is worn but still serviceable.

In accordance with a first preferred embodiment of the invention, the lower end of the mandrel is contoured to conform to the top surface of the bit guide and the annular ridge is positioned adjacent an outer wall of the mandrel end.

In accordance with a second preferred embodiment, an inner wall of a mandrel end extends downwardly past the bit guide to protect a top end of the casing from erosion by abrasives pumped into the well bore during a stimulation process.

BRIEF DESCRIPTION OF THE DRAWINGS

The invention will now be explained by way of example only and with reference to the following drawings in which.

DETAILED DESCRIPTION OF THE PREFERRED EMBODIMENTS

The high pressure seals in accordance with the invention are primarily intended for use with blowout preventer protectors as described in U.S. Pat. No. 5,819,851, the specification of which is incorporated herein by reference in its entirety.

Figure 1:
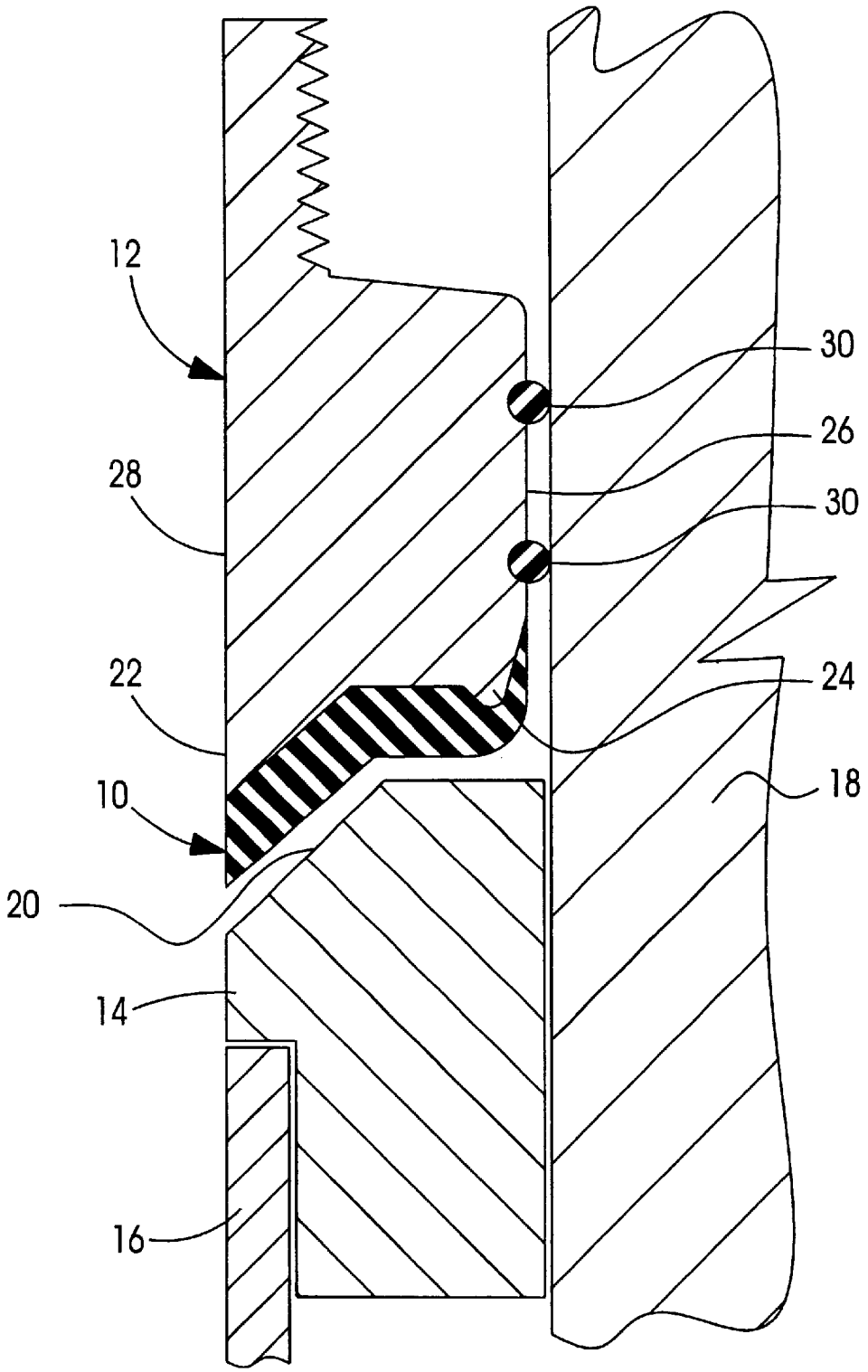
FIG. 1 is a first embodiment in accordance with the invention of a high pressure fluid seal for sealing against a bit guide in a well bore.

FIG. 1 shows a cross-sectional view of a high pressure seal 10 in accordance with the first preferred embodiment of the invention. The seal is mounted to an end of a mandrel 12 as described in applicant's above-referenced United States patent. The mandrel 12 is for insertion into a wellhead as described in detail in applicant's United States patent. The high pressure seal 10 seats against a bit guide 14 which protects a top edge of a well casing 16 in a manner well known in the art. The bit guide 14 is supported inside a tubing head 18, only a portion of which is shown in cross-section. The construction of the tubing head and the bit guide are well understood in the art. The mandrel 12 is a bottom section of a blowout preventer protector described in detail in applicant's U.S. Pat. No. 5,819,851. The mandrel 12 is referred to as a "packoff assembly" because it seals with a top surface 20 of the bit guide 14 to isolate wellhead components from stimulation fluids injected at high pressure into the well bore. The high pressure fluid seal 10 is an elastomeric material preferably made from a thermoplastic material such as polyethylene or a rubber compound such as nitryl rubber. The elastomeric material preferably has a hardness of about 80 to about 100 durometer. As used hereinafter, the terms "high pressure fluid seal" and "elastomeric seal" are synonymous. The elastomeric material is bonded directly to the end 22 of the mandrel 12. The end 22 of the mandrel 12 includes at least one downwardly protruding annular ridge 24 which provides an area of increased compression of the elastomeric seal 10 in an area preferably adjacent an outer wall 26 of the mandrel 12. The mandrel 12 also includes an inner wall 28 which defines the bore through which high pressure stimulation fluids are injected into the well bore.

The annular ridge 24 not only provides an area of increased compression, it also inhibits extrusion of the elastomeric seal 10 from between the mandrel 12 and the bit guide 14 when exposed to extreme fluid pressures. The annular ridge 24 likewise helps ensure that the elastomeric seal 10 securely seats against the bit guide 14, even if the bit guide 14 is worn due to impact and abrasion resulting from the movement of production tubing and/or well tools into or out of the bore.

As shown in FIG. 1, a pair of O-rings 30 are preferably provided as backup seals to further ensure that the wellhead components are isolated from pressurized stimulation fluids.

Figure 2:
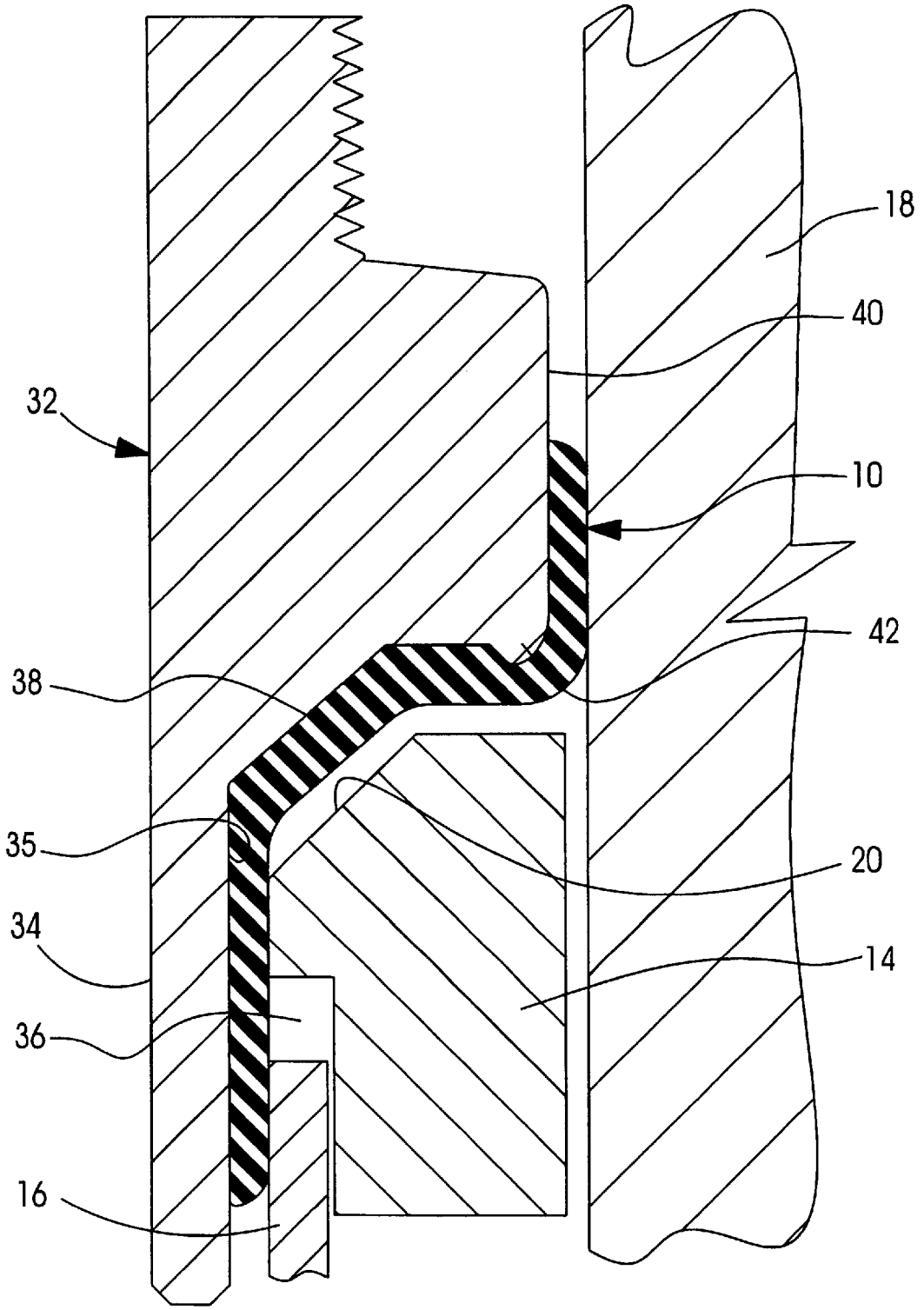
FIG. 2 is a cross-sectional view of a second embodiment in accordance with the invention of the high pressure fluid seal for sealing against a bit guide in a well bore.

FIG. 2 shows a second preferred embodiment of a high pressure fluid seal 10 in accordance with the invention. A mandrel generally indicated by reference 32 differs from the mandrel 12 shown in FIG. 1 insofar as it has a thicker wall, and an inner wall 34 which extends downwardly past the bit guide 14 and a top edge of the well casing 16 into the annulus of the casing 16. This embodiment of the high pressure fluid seal 10 is particularly useful in wellheads where the bit guide 14 does not closely conform to a top edge of the well casing 16, leaving a gap 36 in at least one area of a circumference of a joint between the casing 16 and the bit guide 14. The gap makes the top edge of the casing susceptible to erosion called "washout" if large volumes of abrasives are injected into the well during a well stimulation process. The mandrel 32 in accordance with this embodiment of the invention covers any gaps at the top end of the casing 16 to prevent washout. The length of the inner wall 16 is a matter of design choice. In general, 4–6 inches (10–15 cm) is adequate. The elastomeric seal 10 is bonded directly to the end 38 of the mandrel 32 using techniques well known in the art. The elastomeric seal 10 covers an outer wall portion 35 of the inner wall 34. It also covers a portion of an outer wall 40 located above the end 38. A bottom edge of the outer wall 40 of the mandrel 32 protrudes downwardly in an annular ridge 42 as described above to provide extra compression of the elastomeric seal 10 to ensure that the elastomeric seal 10 is not extruded from between the mandrel 32 and the bit guide 14 when the elastomeric seal is securely seated against the top surface 20 of the bit guide 14.

In use, the mandrel 12, 32 (packoff assembly) is connected to a bottom. end of a mandrel for a blowout prevention protector as described in applicant's U.S. Pat. No. 5,819,851. The mandrel 12, 32 is stroked down through the wellhead until the high pressure fluid seal 10 seats securely against the bit guide 14. As the high pressure fluid seal 10 seats against the top surface 20 of the bit guide 14, the annular protruding ridge 24, 42 compresses the elastomeric material 10 in the area adjacent the outer wall 26, 40 to ensure that the high pressure fluid seal 10 securely seals against the top surface of the bit guide to provide a secure seal even when the bit guide 14 is worn. The annular protruding ridge 24, 42 also ensures that the elastomeric material 10 is not extruded from between the bottom end 22, 38 of the mandrel 12, 32 even under conditions of elevated fluid pressures. The high pressure fluid seals 10 therefore ensure more reliable operation during well stimulation and increased safety for crews involved in well stimulation processes.

Changes and modifications to the embodiments of invention described above may become apparent to those skilled in the art. For example, more than one annular ridge 24, 42 may be provided on the end 22, 38 of the mandrel 12, 32. As another example, the end 22, 38 of the mandrel 12, 32 could be machined in a different contour without sacrificing utility. The scope of the invention is therefore intended to be limited solely by the scope of the appended claims.

I claim:

1. A high pressure fluid seal for sealing against a bit guide in a wellhead, comprising in combination:

a mandrel adapted to be inserted into the wellhead, the mandrel having an inner wall defining a bore, an outer wall and an end to which an elastomeric seal is directly bonded, the end including an annular ridge which protrudes into the elastomeric seal to provide an area of increased compression of the elastomeric seal against the bit guide to inhibit the elastomeric seal from being extruded away from the bore when the elastomeric seal is seated against the bit guide and the bore is subjected to elevated fluid pressures.

2. The high pressure fluid seal as claimed in claim 1 wherein the end is contoured to conform to a top surface of the bit guide.

3. The high pressure fluid seal as claimed in claim 1 wherein the annular ridge is located adjacent the outer wall of the end.

4. The high pressure fluid seal as claimed in claim 1 wherein the end includes an annular extension of the inner wall that extends past the bit guide and into an annulus of a casing of a well bore to which the wellhead is mounted to protect a top edge of the casing from erosion caused by abrasives injected into the well bore during a well stimulation process.

5. The high pressure fluid seal as claimed in claim 4 wherein the annular ridge is located adjacent the outer wall of the end.

6. The high pressure fluid seal as claimed in claim 4 wherein the extension of the inner wall has an outer wall portion and the elastomeric seal is also bonded directly to the outer wall portion.

7. The high pressure fluid seal as claimed in claim 1 wherein the outer wall of the mandrel end includes at least one radial groove for supporting at least one O-ring, the at least one O-ring being adapted to make sealing contact with an interior surface of a tubing head located above the bit guide when the high pressure fluid seal is seated against the bit guide.

8. A high pressure fluid seal for sealing against a bit guide in a wellhead, comprising in combination:

a mandrel adapted to be inserted into the wellhead, the mandrel having an inner wall, an outer wall, and a contoured lower end to which an elastomeric seal is bonded, the elastomeric seal being adapted for sealing engagement with the bit guide, the contoured end including an annular ridge which protrudes into the elastomeric seal to provide an area of increased compression of the elastomeric seal when seated against the bit guides to inhibit the elastomeric seal from being extruded from between the contoured lower end and the bit guide when the elastomeric seal is seated against the bit guide and subjected to elevated fluid pressures.

9. A high pressure fluid seal for sealing against a bit guide in a wellhead and protecting a joint between the bit guide and a top of a well casing to which the wellhead is mounted, comprising in combination:

a mandrel adapted to be inserted into the wellhead, the mandrel having an inner wall that extends downwardly past a top of the bit guide and a top edge of the well casing when the high pressure fluid seal is seated against the bit guide, an outer wall, and a contoured end to which an elastomeric seal is bonded, the elastomeric seal being adapted for sealing engagement with the bit guide, the contoured end including an annular ridge which protrudes into the elastomeric seal to provide an area of increased compression of the elastomeric seal when the elastomeric seal is seated against the bit guide, to inhibit the elastomeric seal from being extruded from between the contoured end and the bit guide when subjected to elevated fluid pressures.

10. A method of performing a well stimulation process, comprising the steps of:

attaching a packoff assembly to an end of a mandrel used to isolate components of a wellhead from elevated fluid pressures used during the well stimulation process, the packoff assembly being adapted to be inserted into the wellhead, the packoff assembly having an inner wall defining a bore, an outer wall and an end for supporting an elastomeric seal, the end including an annular ridge which protrudes into the elastomeric seal to inhibit the seal from being extruded away from the bore when the elastomeric seal is seated against the bit guide and the bore is subjected to elevated fluid pressures;

inserting the mandrel into the wellhead and seating the elastomeric seal against the bit guide in order to isolate components of the wellhead from fluid pressures required for the well stimulation process; and performing the well stimulation process.

* * * * *